US007354139B2

(12) United States Patent
Hirayama

(10) Patent No.: US 7,354,139 B2
(45) Date of Patent: Apr. 8, 2008

(54) PRINTHEAD SUBSTRATE, PRINTHEAD, HEAD CARTRIDGE, AND PRINTING APPARATUS

(75) Inventor: Nobuyuki Hirayama, Fujisawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 383 days.

(21) Appl. No.: 11/137,558

(22) Filed: May 26, 2005

(65) Prior Publication Data

US 2005/0264613 A1 Dec. 1, 2005

(30) Foreign Application Priority Data

May 27, 2004 (JP) ..... 2004-158028

(51) Int. Cl.
*B41J 2/05* (2006.01)

(52) U.S. Cl. ..... 347/57

(58) Field of Classification Search ..... 347/10, 347/12, 57, 58

See application file for complete search history.

(56) References Cited

U.S. PATENT DOCUMENTS 5,173,717 A * 12/1992 Kishida et al. ..... 346/1.1
5,363,134 A * 11/1994 Barbehenn et al. ..... 347/49
5,815,390 A 9/1998 Lakshmikumar
5,886,713 A 3/1999 Okada et al.
6,290,334 B1 * 9/2001 Ishinaga et al. ..... 347/59
6,474,782 B1 * 11/2002 Furukawa ..... 347/50
6,755,580 B2 * 6/2004 Furukawa et al. ..... 400/120.01
2005/0206685 A1 9/2005 Hirayama
2005/0212857 A1 9/2005 Hirayama
2005/0264608 A1 * 12/2005 Hirayama ..... 347/54

FOREIGN PATENT DOCUMENTS

JP 8-118635 5/1996
JP 2001-191531 7/2001
JP 2003-58264 2/2003
JP 2004-50639 2/2004

* cited by examiner

*Primary Examiner*—Anh T. N. Vo
(74) *Attorney, Agent, or Firm*—Fitzpatrick, Cella, Harper & Scinto

(57) ABSTRACT

A driving circuit layout can suppress an increase in the area of a head substrate in an inkjet printhead by adopting a driving method for supplying a predetermined current to a heater. A plurality of printing elements and a plurality of switching elements which are very large in number are arrayed in the longitudinal direction of a head substrate. A plurality of terminals which receive a driving signal and a control signal that are used to drive the plurality of printing elements are arranged at the end of the board in the longitudinal direction of the board at positions opposite to the array of the plurality of printing elements. A constant electric current source for supplying a predetermined electric current is interposed between these two regions.

6 Claims, 17 Drawing Sheets

PRINTHEAD SUBSTRATE, PRINTHEAD, HEAD CARTRIDGE, AND PRINTING APPARATUS

FIELD OF THE INVENTION

This invention relates to a printhead substrate, printhead, head cartridge, and printing apparatus and, more particularly, to a printhead substrate, containing a circuit for driving a printing element by sending a predetermined electric current, which is used to print in accordance with an inkjet method, printhead, head cartridge, and printing apparatus.

BACKGROUND OF THE INVENTION

An inkjet printhead (to be referred to as a printhead hereinafter), which generates thermal energy by sending an electric current to a heater arranged in the nozzle so as to discharges ink, has conventionally been known.

This printhead is a printhead which employs a method of bubbling ink near the heater by using the generated thermal energy, and discharging ink from the nozzle to print.

In order to print at a high speed, heaters (printing elements) mounted in a printhead are desirably concurrently driven as many as possible to discharge ink at the same timings. However, due to the limited capacity of the power supply of a printing apparatus having the printhead and a voltage drop caused by the resistance of a wiring line extending from the power supply to the heater, a current value which can be supplied at once is limited. For this reason, a time divisional driving method of time-divisionally driving a plurality of heaters to discharge ink is generally adopted. For example, a plurality of heaters are divided into a plurality of groups, and time divisional control is so executed as not to concurrently drive two or more heaters in each group. This can suppress a total electric current flow through heaters and eliminate the need to supply large power at once.

FIG. 14 is a circuit diagram showing an example of the arrangement of a heater driving circuit mounted in a conventional inkjet printhead.

The heater driving circuit shown in FIG. 14 is configured by mounting x heaters in each of m groups so as to concurrently drive one heater in each group, i.e., a total of m heaters, perform this operation x times, and complete-driving of one cycle.

As shown in FIG. 14, MOS transistors 1102-11 to **1102-*mx* corresponding to respective heaters 1101-11 to 1101-*mx* are divided into m groups 1100-1 to 1100-*m* which contain the same number of (x) MOS transistors. More specifically, in the group 1100-1, a power supply line from a power supply pad 1103 (power source terminal) is commonly connected to the heaters 1101-11 to 1101-1*x*, and the MOS transistors 1102-11 to 1102-1*x* are series-connected to the corresponding heaters 1101-11 to 1101-1*x* between the power supply pad 1103 and ground (GND) 1104**.

When a control signal is supplied from a control circuit 1105 to the gates of the MOS transistors 1102-11 to **1102-1*x*, the MOS transistors 1102-11 to 1102-1*x* are turned on so that an electric current can flow from the power supply line through corresponding heaters and the heaters 1101-11 to 1101-1*x*** are heated.

FIG. 15 is a timing chart showing a timing at which an electric current is sent to drive heaters in each group of the heater driving circuit shown in FIG. 14. FIG. 15 exemplifies the group 1100-1 in FIG. 14.

In FIG. 15, control signals VG1 to VGx are timing signals for driving the first to x-th heaters 1101-11 to **1101-1*x* belonging to the group 1100-1. More specifically, the control signals VG1 to VGx represent the waveforms of signals input to the control terminals of the MOS transistors 1102-11 to 1102-1*x* of the group 1100-1. A corresponding MOS transistor 1102-1*i* (i=1, x) is turned on for a high-level control signal, and a corresponding MOS transistor is turned off for a low-level control signal. This also applies to the remaining groups 1100-2 to 1100-*m*. In FIG. 15, Ih1 to Ihx represent current values flowing through the heaters 1101-11 to 1101-1*x***.

In this manner, heaters in each group are sequentially and time-divisionally driven by sending an electric current. The number of heaters driven in each group by sending an electric current can always be controlled to one or less, and no large electric current need be supplied to a heater.

FIG. 16 is a view showing the layout of power supply lines connected from the power supply pad 1103 to the groups 1100-1 to **1100-*m* shown in FIG. 14. In other words, FIG. 16 is a view showing part of the layout of a board (head substrate) which forms the heater driving circuit shown in FIG. 14. Particularly, FIG. 19** shows the layout of power supply wiring part in a case where heaters (not shown) are arranged on an upper side of this drawing paper.

As shown in FIG. 16, power supply lines 1301-1 to **1301-*m* are individually connected from the power supply pad 1103 to the respective groups 1100-1 to 1100-*m*, and power supply lines 1302-1 to 1302-*m* are connected to the ground (GND) pad 1104**. In a printhead having m x x heaters (printing elements), time divisional driving of sequentially driving one printing element in each group requires m power supply lines and m ground lines.

As described above, by keeping the maximum number of heaters concurrently driven in each group to one or less, a current value flowing through a wiring line divided for each group can always be suppressed to be equal to or smaller than a current flowing through one heater. Even when a plurality of heaters are concurrently driven, voltage drop amounts on wiring lines on the heater substrate can be made constant. At the same time, even when a plurality of heaters belonging to different groups are concurrently driven, the amounts of energy applied to respective heaters can be made almost constant.

Recently, printing apparatuses require higher speeds and higher precision, and a mounted printhead integrates a larger number of nozzles at a higher density. In heater driving of the printhead, heaters are required to be simultaneously driven as many as possible at a high speed in terms of the printing speed.

A printhead substrate (to be referred to as a head substrate hereinafter) which integrates heaters and their driving circuit is prepared by forming many heaters and their driving circuit on the same semiconductor substrate. In the manufacturing process, the number of heater substrates formed from one semiconductor wafer must be increased to reduce the cost, and downsizing of the head substrate is also demanded.

When, however, the number of concurrently driven heaters is increased, as described above, the head substrate requires wiring lines corresponding to the number of concurrently driven heaters. As the number of wiring lines increases, the wiring region per wiring line decreases to increase the wiring resistance when the area of the head substrate is limited. Further, each wiring width decreases, and variations in resistance between wiring lines on the head substrate increase. This problem occurs also when the head substrate is downsized, and the wiring resistance and variations in resistance increase. Since heaters and power supply lines are series-connected to the power supply on the head substrate, as described above, increases in wiring resistance and variations in resistance lead an increase in the variation of a voltage applied to each heater.

When energy applied to a heater is too small, ink discharge becomes unstable; when the energy is too large, the heater durability degrades. In other words, in a case where the variation of the voltage applied to heaters is large, the heater durability degrades or ink discharge becomes unstable. For this reason, to print with high quality, energy applied to a heater is desirably constant. Furthermore, it is also desirable to stably apply appropriate energy in view of the durability.

In the above-described time divisional driving where the number of concurrently driven heater is one or less, the voltage drop can be suppressed within the head substrate. However, since a wiring line outside the head substrate is common to a plurality of heaters of plural groups, the amount of voltage drop on the common wiring line changes depending on the number of concurrently driven heaters. In order to make energy applied to each heater constant against variations in the above voltage drop, energy applied to each heater is conventionally adjusted by the voltage application time. However, as the number of concurrently driven heaters increases, a current flowing through a common wiring line generates a large amount of voltage drop. As a result, the voltage applied to a heater decreases. The voltage application time in heater driving must be prolonged to compensate for the voltage drop, and this makes it difficult to drive a heater at a high speed.

As a method which solves such problems caused by variations in energy applied to a heater, for example, Japanese Patent Publication Laid-Open No. 2001-191531 proposes a method of driving a printing element by a constant current.

FIG. 17 is a circuit diagram showing a heater driving circuit disclosed in Japanese Patent Laid-Open No. 2001-191531.

In this arrangement, printing elements (R1 to Rn) are driven by a constant current using constant current sources (Tr14 to Tr(n+13)) and switching elements (Q1 to Qn) which are arranged for the respective printing elements (R1 to Rn).

However, constant current driving disclosed in Japanese Patent Publication Laid-Open No. 2001-191531 requires transistors equal in number to printing elements in addition to switching elements (Q1 to Qn). As a result, the area of the heater substrate becomes much larger than that in a conventional driving method, and the cost of the heater substrate becomes higher.

In order to stabilize energy applied to a heater, output currents from a plurality of constant current sources must be uniform. However, as the number of constant current sources increases, output currents from these constant current sources vary much more. It is difficult to reduce variations in output current between a plurality of constant current sources particularly on a head substrate having a greater number of heaters for higher speed and higher precision of printing in the printing apparatus.

SUMMARY OF THE INVENTION

Accordingly, the present invention is conceived as a response to the above-described disadvantages of the conventional art.

For example, a printhead substrate, a printhead integrating the printhead substrate, a head cartridge integrating the printhead, and a printing apparatus using the printhead according to the present invention are capable of downsizing the size, driving a printing element at a high speed while adopting a constant current driving method of supplying a constant current to each printing element to drive it.

For this downsizing, a driving circuit which solved the above-described technical problems is optimally arranged on the head substrate.

According to one aspect of the present invention, preferably, there is provided a printhead substrate used for driving a plurality of printing elements provided on a board according to a driving method in which a constant electric current flows into the plurality of printing elements through a plurality of switching elements respectively corresponding to the plurality of printing elements, wherein the plurality of printing elements and the plurality of switching elements are arrayed in a longitudinal direction of the board, a terminal which receives which receive a driving signal and a control signal that are used to drive the plurality of printing elements are arrayed at an end of the board in the longitudinal direction of the board at positions different from arrangement positions of the plurality of printing elements, and a constant electric current source for supplying the constant electric current is arranged at a position closer to an area where the plurality of terminals are arranged than an area where the plurality of switching elements are arrayed.

Preferably, the printhead substrate further comprises a control circuit for controlling drive of the plurality of switching elements, wherein the constant electric current source is arranged at a position closer to the area where the plurality of terminals are arranged than the area where the control circuit is arranged.

In this arrangement, in a case where the constant electric current source includes a plurality of constant electric current sources, the plurality of constant electric current sources are preferably arranged at equal intervals in the longitudinal direction of the board.

Alternatively, in a case where the constant electric current source includes a plurality of constant electric current sources, the plurality of constant electric current sources are preferably arranged in the longitudinal direction of the board, and the arrangement may be centralized at a center of the board.

According to another aspect of the present invention, preferably, there is provided a printhead substrate used for driving a plurality of printing elements provided on a board according to a driving method in which a constant electric current flows into the plurality of printing elements through a plurality of switching elements respectively corresponding to the plurality of printing elements, wherein the plurality of printing elements and the plurality of switching elements are arrayed in a longitudinal direction of the board, a plurality of terminals which receive a driving signal and a control signal that are used to drive the plurality of printing elements are arrayed at an end of the board in the longitudinal direction of the board at positions different from arrangement positions of the plurality of printing elements, and a plurality of electric current sources for supplying the constant electric current are respectively arranged in areas between the plurality of terminals.

In the above arrangement, a control circuit which controls ON/OFF operation of the plurality of switching elements on the basis of the driving signal and the control signal is desirably arranged in the longitudinal direction of the board.

According to still another aspect of the present invention, preferably, there is provided a printhead using a printhead substrate having the above arrangement.

The printhead desirably includes an inkjet printhead which prints by discharging ink.

According to still another aspect of the present invention, preferably, there is provided a head cartridge integrating the above inkjet printhead and an ink tank containing ink to be supplied to the inkjet printhead.

According to still another aspect of the present invention, preferably, there is provided a printing apparatus for discharging ink into a printing medium for printing by using an inkjet printhead or head cartridge having the above arrangement.

The invention is particularly advantageous since the area of the head board can be effectively utilized and also the wiring lengths between printing elements, switching elements, electric current sources, and terminals can be shortened on the head board. Hence, the present invention can provide a head substrate using a constant electric current driving method capable of stable printing at a high speed without increasing the size of the head substrate.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the description, serve to explain the principles of the invention.

DETAILED DESCRIPTION OF THE PREFERRED EMBODIMENTS

Preferred embodiments of the present invention will now be described in accordance with the accompanying drawings.

In this specification, the terms "print" and "printing" not only include the formation of significant information such as characters and graphics, but also broadly includes the formation of images, figures, patterns, and the like on a print medium, or the processing of the medium, regardless of whether they are significant or insignificant and whether they are so visualized as to be visually perceivable by humans.

Also, the term "print medium" not only includes a paper sheet used in common printing apparatuses, but also broadly includes materials, such as cloth, a plastic film, a metal plate, glass, ceramics, wood, and leather, capable of accepting ink.

Furthermore, the term "ink" (to be also referred to as a "liquid" hereinafter) should be extensively interpreted similar to the definition of "print" described above. That is, "ink" includes a liquid which, when applied onto a print medium, can form images, figures, patterns, and the like, can process the print medium, and can process ink (e.g., can solidify or insolubilize a coloring agent contained in ink applied to the print medium).

Furthermore, unless otherwise stated, the term "inozzle" generally means a set of a discharge orifice, a liquid channel connected to the orifice and an element to generate energy utilized for ink discharge.

The following printhead substrate (head substrate) means not only a base of a silicon semiconductor but also a base having elements, wiring lines, and the like.

Furthermore, the term "on a substrate" means not only "on an element substrate", but also "the surface of an element substrate" or "inside an element substrate near the surface". The term "built-in" in the present invention does not represent that each separate element is arranged as a separate member on a substrate surface, but represents that each element is integrally formed and manufactured on an element substrate by a semiconductor circuit manufacturing process or the like.

The term "constant electric current" and "constant electric current source" means a predetermined constant electric current to be supplied to a printing element regardless of a variation on a number of concurrently driven printing element(s) or the like, and an electric current source which supplies the electric current. The value itself of the electric current which is expected to be constant also includes a case where it is variably set to a predetermined electric current value.

<Brief Description of Apparatus Main Unit (FIG. 1)>

Figure 1:
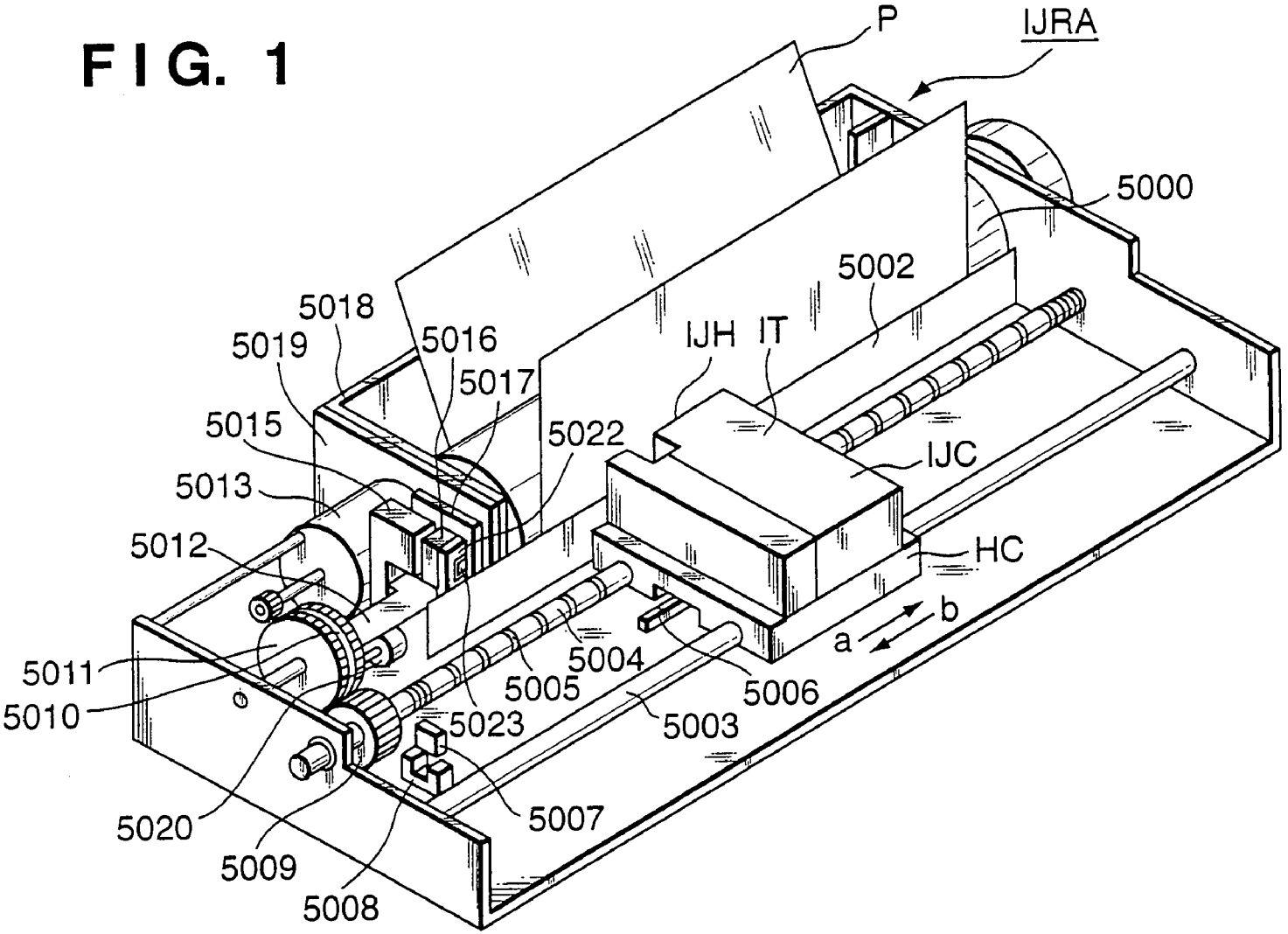
FIG. 1 is an outer perspective view showing a schematic arrangement around the carriage of an inkjet printing apparatus as a typical embodiment of the present invention.

FIG. 1 is a perspective view showing the outer appearance of an inkjet printing apparatus as a typical embodiment of the present invention. Referring to FIG. 1, a carriage HC engages with a spiral groove 5004 of a lead screw 5005, which rotates via driving force transmission gears 5009 to 5011 upon forward/reverse rotation of a driving motor 5013. The carriage HC has a pin (not shown), and is reciprocally scanned in the directions of arrows a and b in FIG. 1. An inkjet cartridge IJC which incorporates an inkjet printhead IJH (hereinafter referred to as "printhead") and an ink tank IT for containing ink is mounted on the carriage HC.

The inkjet cartridge IJC integrally includes the printhead IJH and the ink tank IT.

Reference numeral 5002 denotes a sheet pressing plate, which presses a paper sheet against a platen 5000, ranging from one end to the other end of the scanning path of the carriage. Reference numerals 5007 and 5008 denote photocouplers which serve as a home position detector for recognizing the presence of a lever 5006 of the carriage in a corresponding region, and used for switching, e.g., the rotating direction of the motor 5013. Reference numeral 5016 denotes a member for supporting a cap member 5022, which caps the front surface of the printing head IJH; and 5015, a suction device for sucking ink residue through the interior of the cap member. The suction device 5015 performs suction recovery of the printing head via an opening 5023 of the cap member 5015. Reference numeral 5017 denotes a cleaning blade; 5019, a member which allows the blade to be movable in the back-and-forth direction of the blade. These members are supported on a main unit support plate 5018. The shape of the blade is not limited to this, but a known cleaning blade can be used in this embodiment. Reference numeral 5012 denotes a lever for initiating a suction operation in the suction recovery operation. The lever 5012 moves upon movement of a cam 5020, which engages with the carriage, and receives a driving force from the driving motor via a known transmission mechanism such as clutch switching.

The capping, cleaning, and suction recovery operations are performed at their corresponding positions upon operation of the lead screw 5005 when the carriage reaches the home-position side region. However, the present invention is not limited to this arrangement as long as desired operations are performed at known timings.

Figure 2:
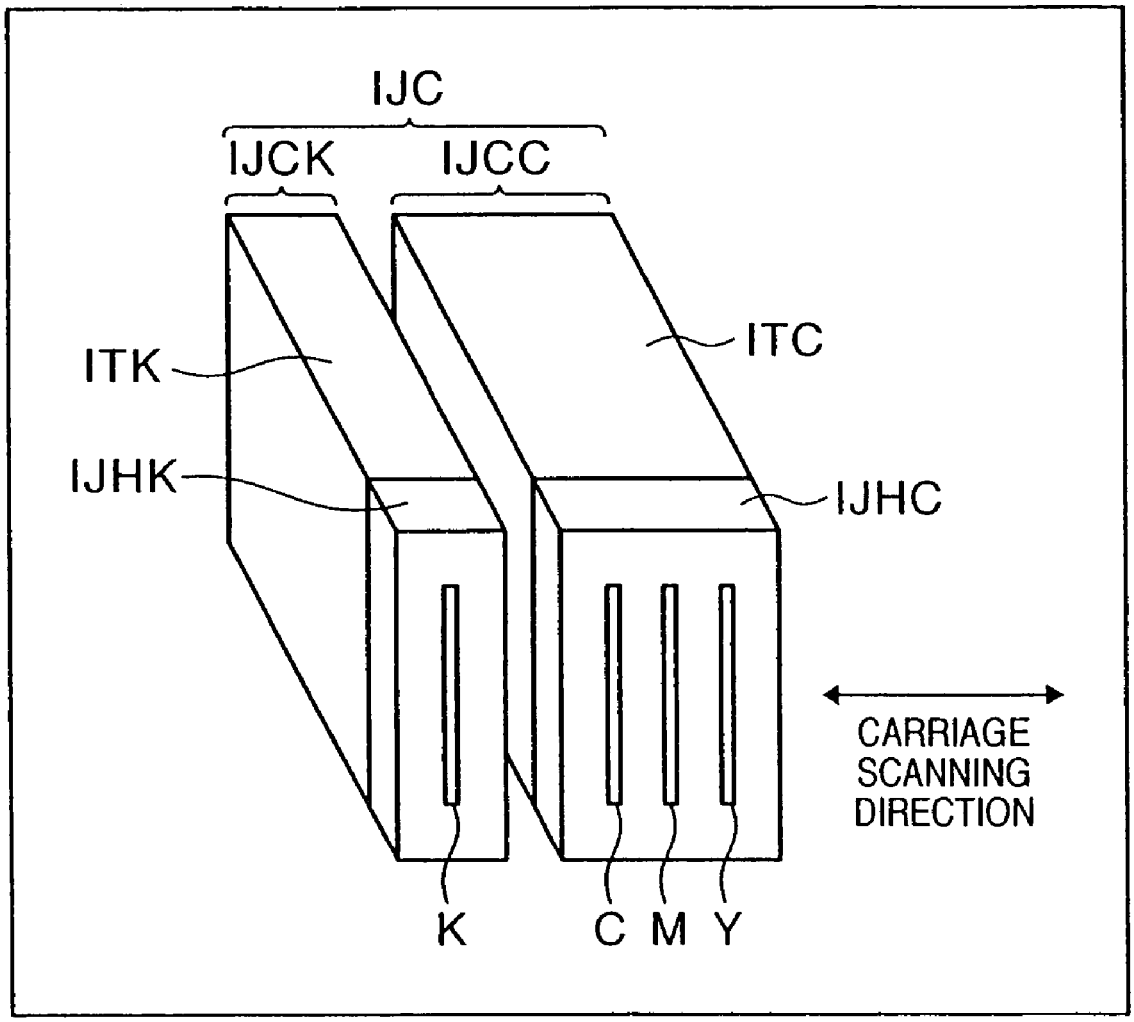
FIG. 2 is an outer perspective view showing the detailed arrangement of an inkjet cartridge IJC.

FIG. 2 is a perspective view showing a detailed outer appearance of the configuration of an inkjet cartridge IJC.

As shown in FIG. 2, the inkjet cartridge IJC is comprised of a cartridge IJCK that discharges black ink and a cartridge IJCC that discharges three colors of ink, cyan (C), magenta (M) and yellow (Y). These two cartridges are mutually separable, with each being independently detachably mounted on the carriage HC.

The cartridge IJCK is comprised of an ink tank ITK that contains black ink and a printhead IJHK that prints by discharging black ink, combined in an integrated structure. Similarly, the cartridge IJCC is comprised of an ink tank ITC that contains ink of three colors, cyan (C), magenta (M) and yellow (Y), and a printhead IJHC that prints by discharging ink of these colors, combined in an integrated structure. Note that it is assumed that the cartridge in this embodiment is a cartridge in which ink is filled in the ink tank.

The cartridges IJCK and IJCC are not limited to the integrated-type, and the ink tank and printhead may be separable.

The printhead IJH is used to generally refer to the printheads IJHK and IJHC together.

Further, as can be appreciated from FIG. 2, an array of nozzles that discharges black ink, an array of nozzles that discharges cyan ink, an array of nozzles that discharges magenta ink and an array of nozzles that discharges yellow ink are aligned in a direction of movement of the carriage, the arrayed direction of the nozzles being disposed diagonal to the carriage movement direction.

Figure 3:
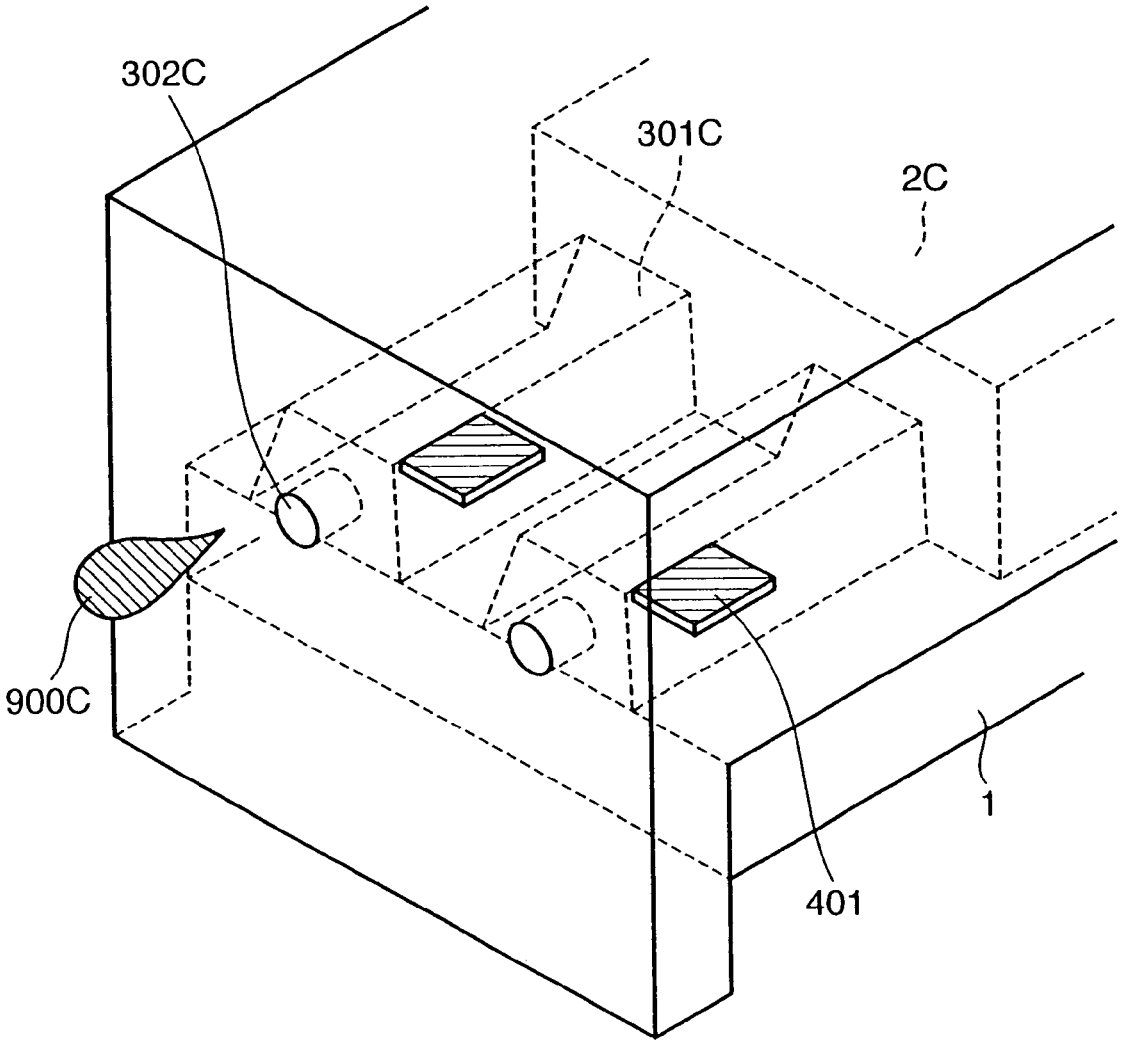
FIG. 3 is a perspective view showing part of the three-dimensional structure of a printhead IJHC which discharges ink.

FIG. 3 is a perspective view showing part of a three-dimensional structure of a printhead that discharges ink.

FIG. 3 exemplifies two nozzles which receive cyan (C) ink and discharge ink droplets. The number of nozzles is generally much larger, and this structure also applies to the remaining color inks.

The printhead IJHC has an ink channel 2C that supplies cyan (C) ink, an ink channel (not shown) that supplies magenta (M) ink, and an ink channel (not shown) that supplies yellow (Y) ink.

Particularly, FIG. 3 reveals the flow of cyan (C) ink supplied from the ink tank ITC.

As shown in FIG. 3, the ink flow path 301C is provided in correspondence to electrothermal transducers (heaters) 401. The cyan ink that pass through the ink flow path 301C is led to electrothermal transducers (that is, heaters) 401 provided on the substrate. Then, when the electrothermal transducers (heaters) 401 are activated via circuits to be described later, the ink on the electrothermal transducers (heaters) 401 is heated, the ink boils, and, as a result, ink droplet 900C is discharged from the orifice 302C by the bubble that arises.

In the arrangement shown in FIG. 3, the ink orifice 302C, ink channel 2C, and ink flow path 301C are arranged in a straight line. Alternatively, a so-called side-shooter type arrangement may be employed in which the orifice 302 is arranged opposite to the electrothermal transducers (heaters) 401.

It should be noted that, in FIG. 3, reference numeral 1 denotes a printhead substrate (hereinafter referred to as "head substrate") on which are formed electrothermal transducers and the variety of circuits that drive the electrothermal transducers to be described later, a memory, a variety of pads that form the electrical contacts with the carriage HC, and a variety of signal wires.

Moreover, one electrothermal transducer (heater), and the MOS-FET that drives it are together called a printing element, with a plurality of printing elements called a printing element portion.

Note that although FIG. 3 is a diagram showing a three-dimensional structure of a printhead IJHC that discharges one color ink (cyan ink) among a plurality of color inks, the structure is the same as that of the printhead that discharges the remaining color inks.

Next, a description is given of the control configuration for executing print control of the printing apparatus described above.

Figure 4:
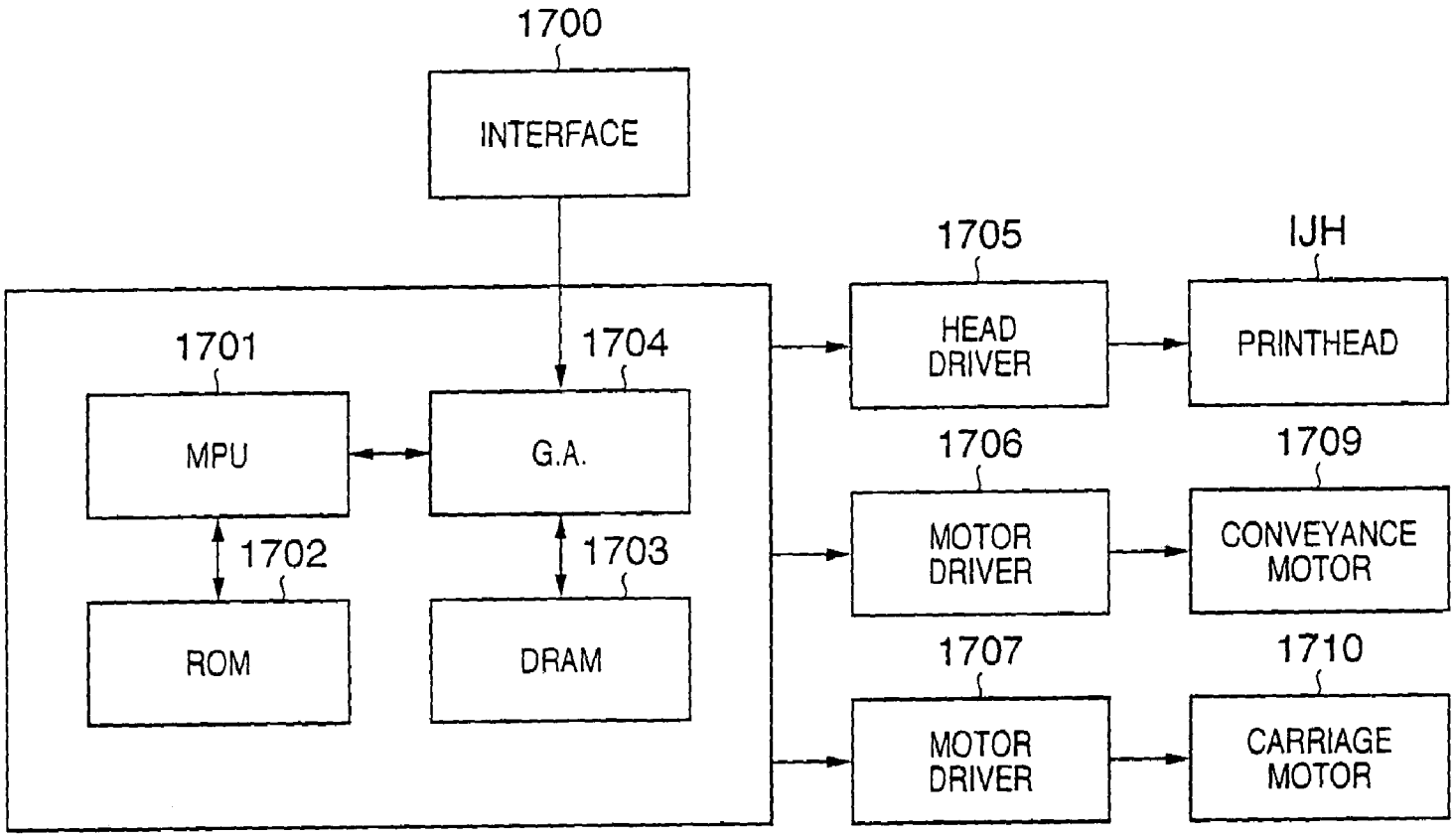
FIG. 4 is a block diagram showing the control arrangement of the printing apparatus shown in FIG. 1.

FIG. 4 is a block diagram showing the arrangement of a control circuit of the printing apparatus.

Referring to FIG. 4 showing the control circuit, reference numeral 1700 denotes an interface for inputting a printing signal; 1701, an MPU; 1702, a ROM for storing a control program executed by the MPU 1701; and 1703, a DRAM for storing various data (the printing signal, printing data supplied to the printhead, and the like). Reference numeral 1704 denotes a gate array (G.A.) for performing supply control of printing data to the printhead IJH. The gate array 1704 also performs data transfer control among the interface 1700, the MPU 1701, and the RAM 1703.

Reference numeral 1709 denotes a conveyance motor (not shown in FIG. 1) for conveying a printing sheet P. Reference numeral 1706 denotes a motor driver for driving the conveyance motor 1709, and reference numeral 1707 denotes a motor driver for driving the carriage motor 5013.

The operation of the above control arrangement will be described next. When a printing signal is input to the interface 1700, the printing signal is converted into printing data for a printing operation between the gate array 1704 and the MPU 1701. The motor drivers 1706 and 1707 are driven, and the printhead IJH is driven in accordance with the printing data supplied to the carriage HC, thus printing an image on the printing paper P.

The embodiment uses printheads having the arrangement as shown in FIG. 2, and they are controlled so that printing by the printhead IJHK and printing by the printhead IJHC do not overlap each other in each scanning of the carriage. In color printing, the printheads IJHK and IJHC are alternately driven in each scanning. For example, when the carriage reciprocally scans, the printheads IJHK and IJHC are so controlled as to drive the printhead IJHK in forward scan and the printhead IJHC in backward scan. Driving control of the printheads is not limited to this, and printing operation may be done in only forward scan and the printheads IJHK and IJHC may be driven in two forward scan operations without conveying the printing sheet P.

The arrangement and operation of the head substrate integrated in the printhead IJH will be explained.

Figure 5:
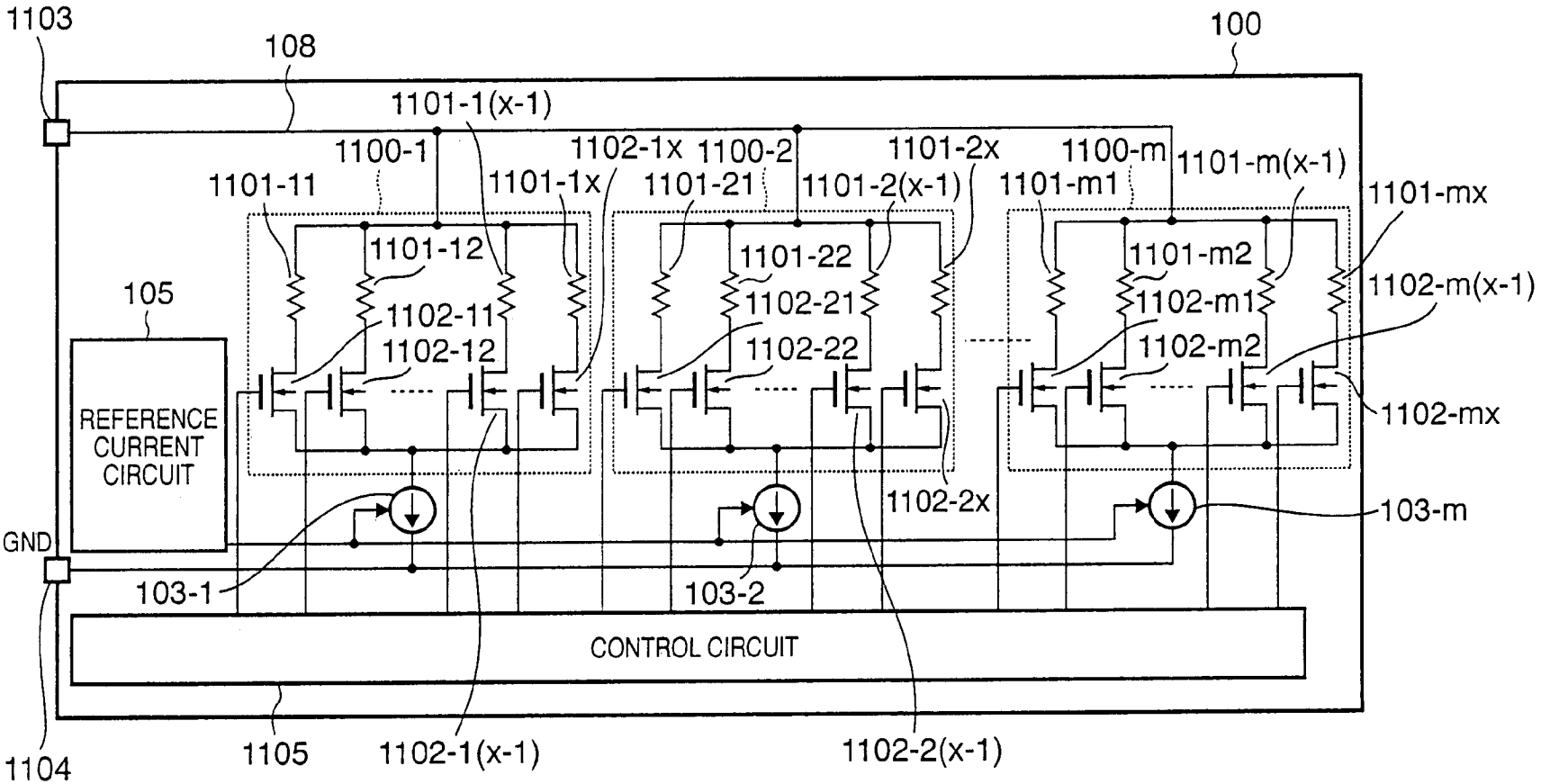
FIG. 5 is a circuit diagram showing an example of the arrangement of a head substrate, which forms a heater driving circuit, mounted on a printhead IJH.

FIG. 5 is a circuit diagram showing an example of the arrangement of a head substrate which forms a heater driving circuit built in the printhead IJH.

Figure 14:
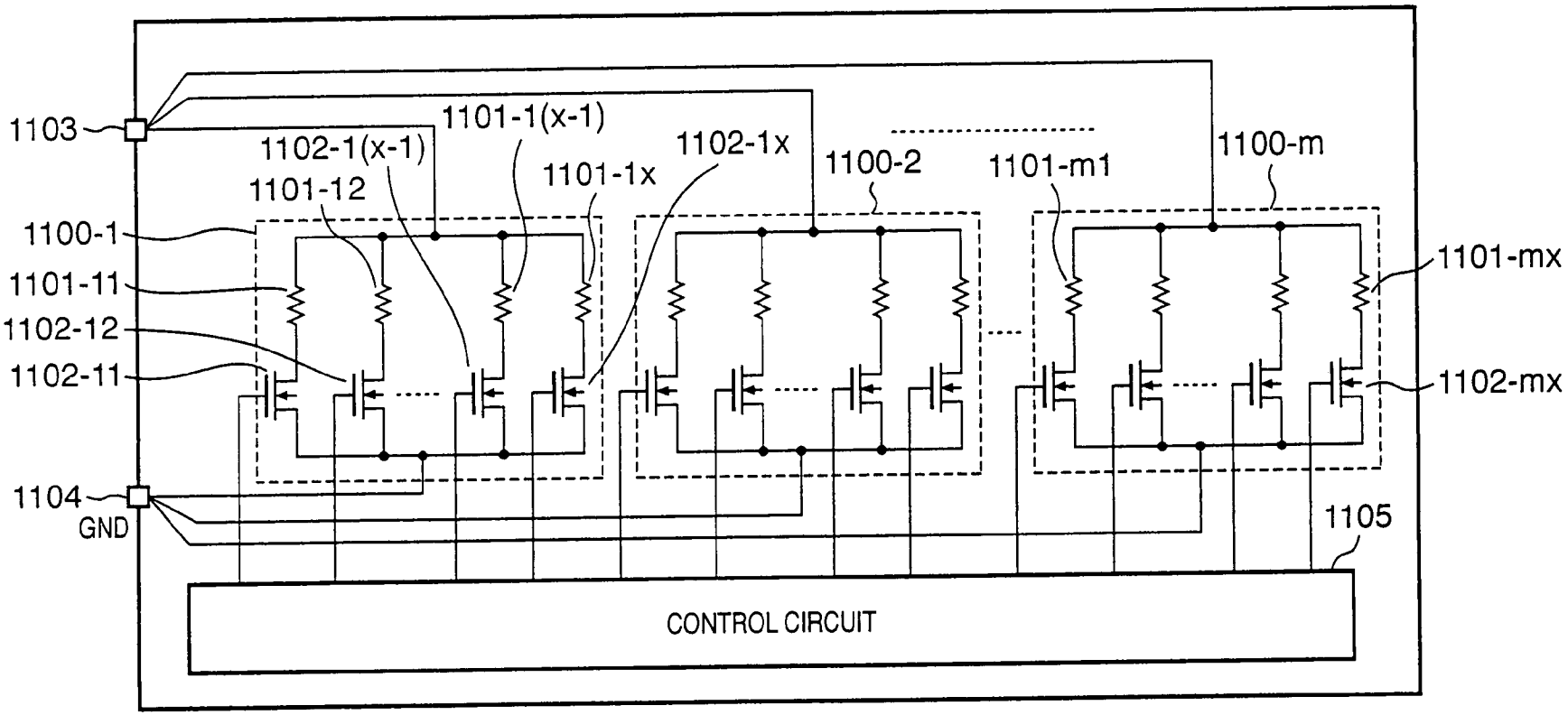
FIG. 14 is a circuit diagram showing an example of the arrangement of a heater driving circuit mounted in a conventional inkjet printhead.
Figure 15:
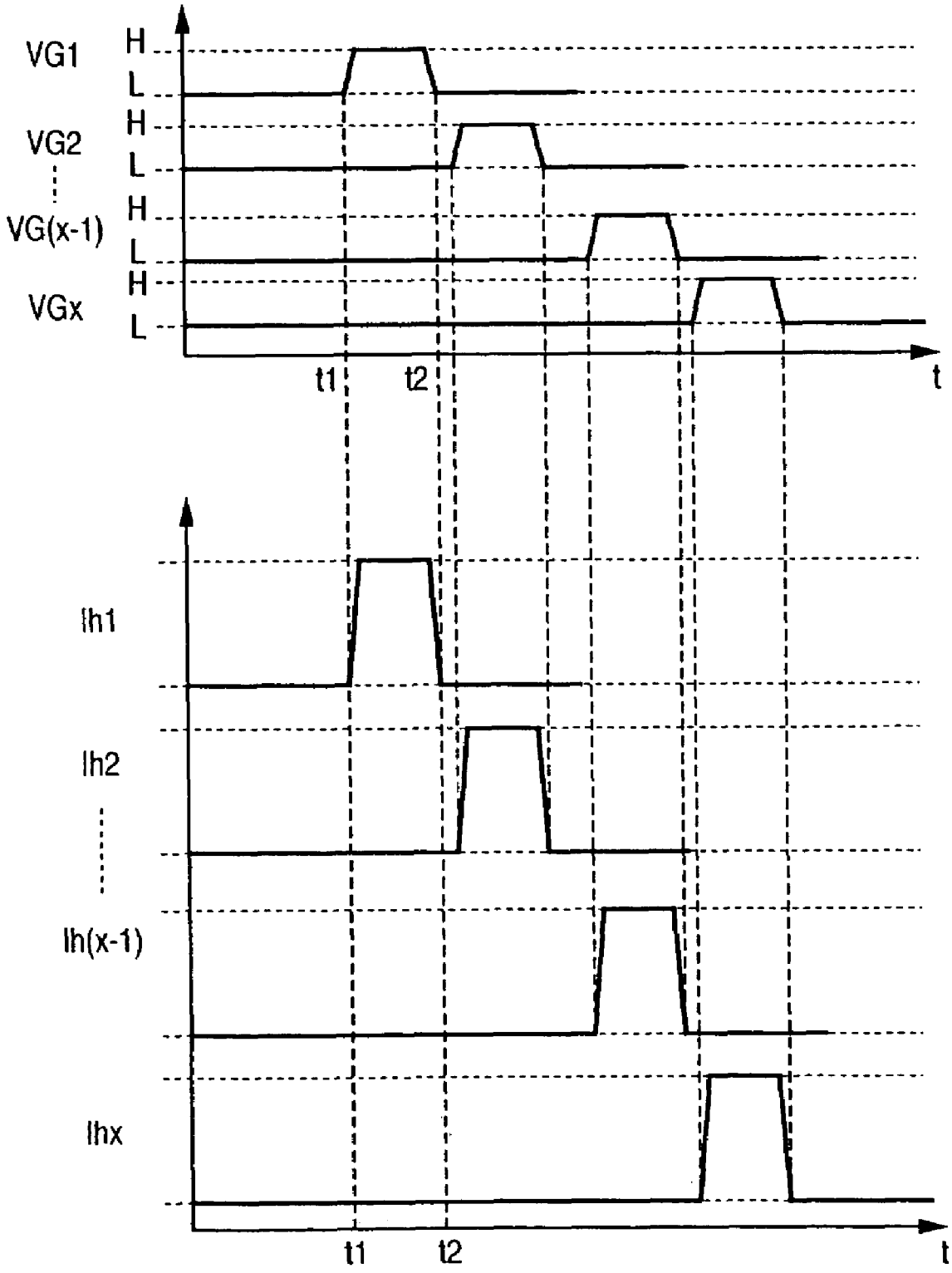
FIG. 15 is a timing chart showing a timing at which an electric current is sent to drive heaters in each group of the heater driving circuit shown in FIG. 14.
Figure 16:
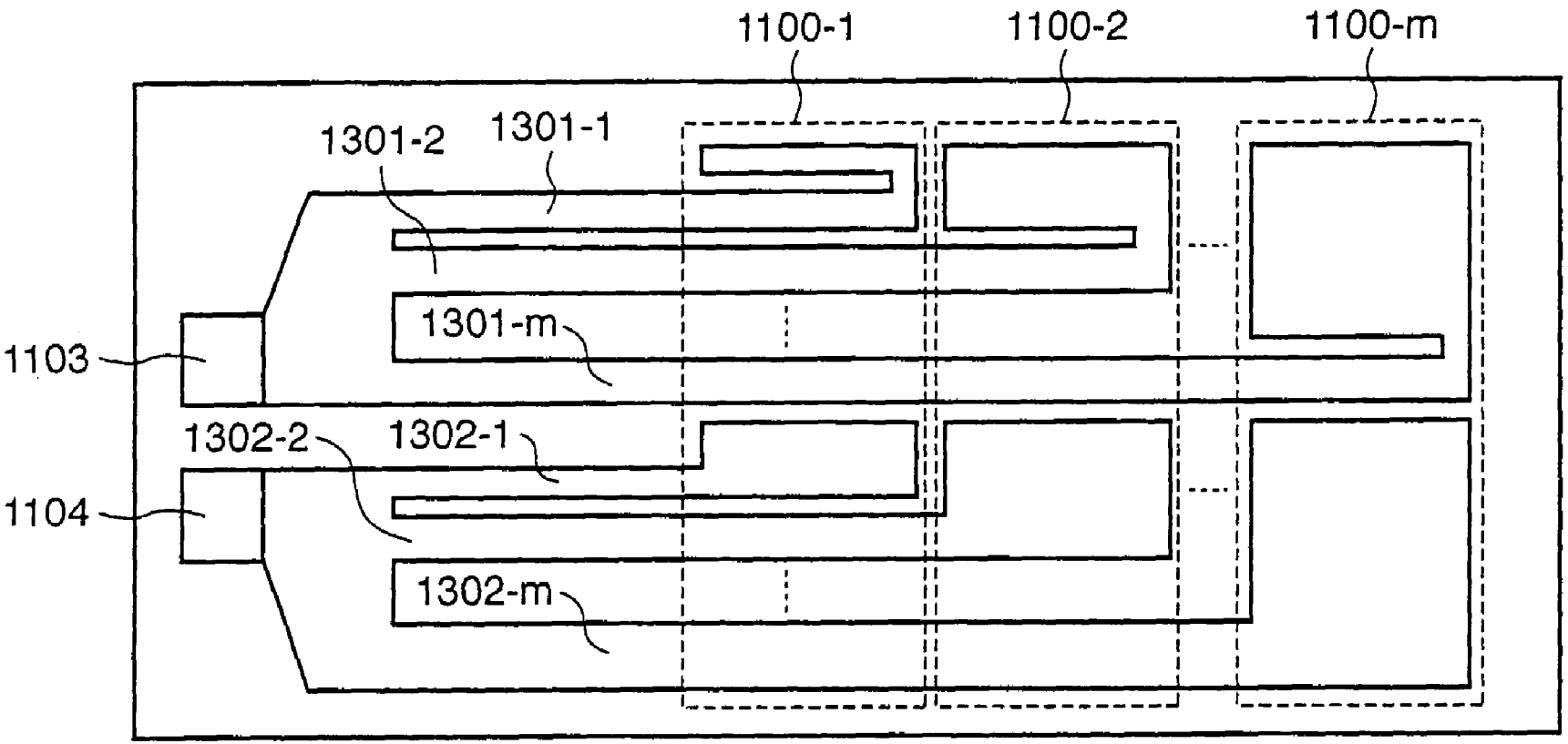
FIG. 16 is a view showing the layout of power supply lines connected from a power supply pad 1103 to groups 1100-1 to **1100-*m* shown in FIG. 14.
Figure 17:
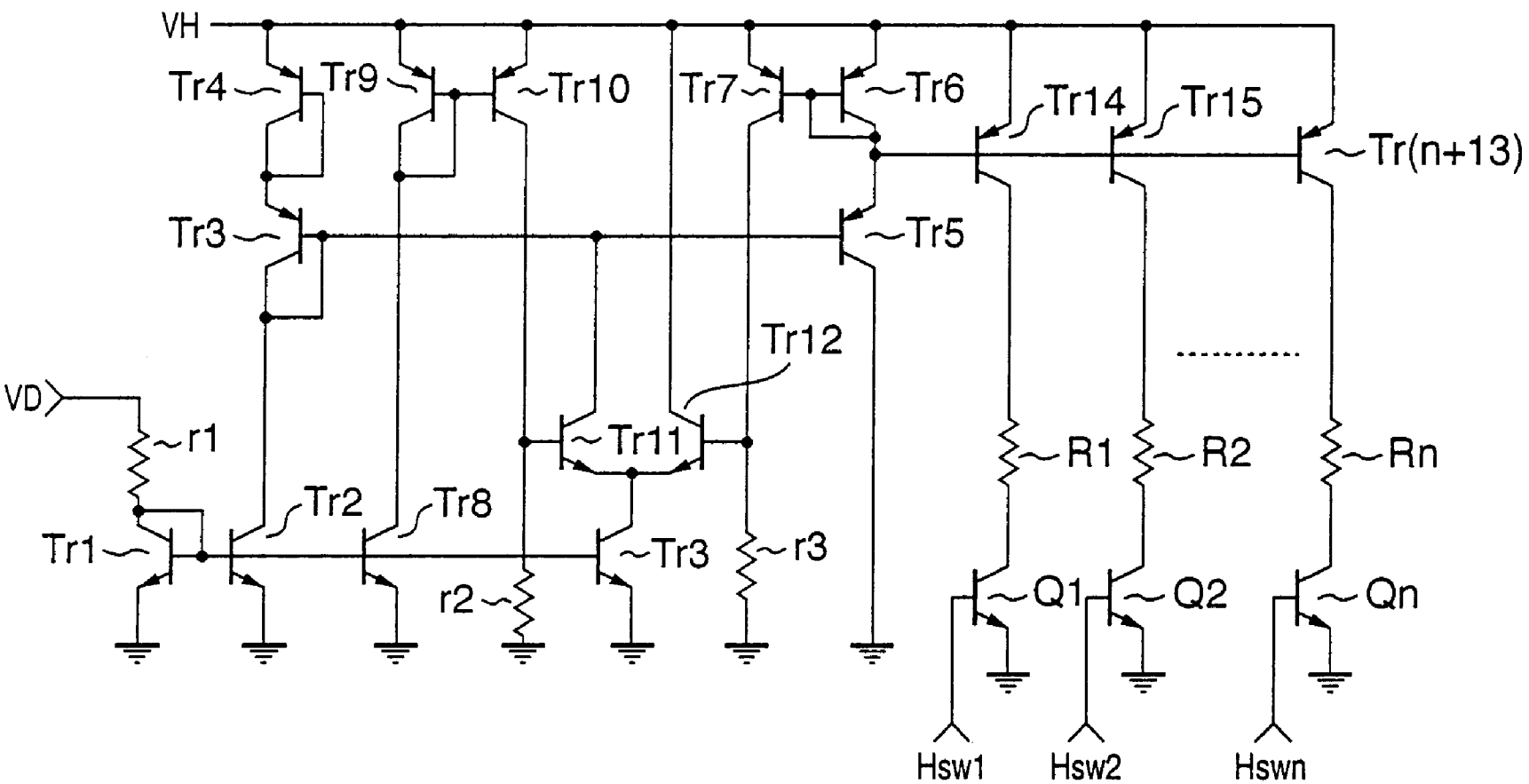
FIG. 17** is a circuit diagram showing a heater driving circuit according to the conventional art.

In FIG. 5, the same reference numerals as those of the conventional case in FIG. 14 denote the same building components, and a description thereof will be omitted. Similar to the conventional case, the arrangement exemplified in FIG. 5 employs a time divisional driving method in which (m×x) heaters and (m×x) switching elements (MOS transistors) are divided into m groups each having x heaters and x switching elements, and one heater is concurrently selected and driven in each group.

In FIG. 5, reference numerals 103-1 to **103-*m* denote constant electric current sources; and 105**, a reference current circuit.

In the heater driving circuit, as shown in FIG. 5, the constant electric current sources 103-1 to **103-*m*** for supplying an electric current to heaters are connected to the respective groups.

For example, in a group 1100-1, the source terminals of MOS transistors 1102-11 to **1102-1*x* respectively series-connected to heaters 1101-11 to 1101-1*x* are commonly connected, the terminals of the heaters on one end in the group are also commonly connected, and the constant electric current source 103-1 is connected to the group. A power supply line 108 is connected to the common connection terminal of the heaters 1101-11 to 1101-1*x***.

The MOS transistors 1102-11 to **1102-1*x* serving as the driving switches for the heaters 1101-11 to 1101-1*x* are series-connected between the power supply line 108 and ground (GND). The high-voltage tolerant MOS transistor 103-1 serving as one of constant electric current sources for sending a predetermined electric current to the heaters 1101-11 to 1101-1*x* is series-connected as a common switch between the MOS transistors 1102-11 to 1102-1*x* and ground (GND). Note that, in this embodiment, the MOS transistors (constant electric current sources) 103** are operable in a saturated region to send a predetermined electric current.

The remaining groups 1100-2 to **1100-*m* also have the same arrangement as that of the group 1100-1**.

When the heater driving circuit is viewed as a whole, the heaters 1101-11 to **1101-*mx*, the MOS transistors 1102-11 to 1102-*mx* which function as switches, the constant electric current sources 103-1 to 103-*m* and ground wirings in order from the power supply wiring side are series-connected. The respective constant electric current sources 103-1 to 103-*m* output constant electric currents to the common connection terminals of corresponding groups. The magnitude of the output current value is adjusted by a control signal from the reference current circuit 105**.

The operation of the heater driving circuit having the above arrangement will be described.

This operation is common to the m groups, and one group formed from x heaters will be exemplified.

Figure 6:
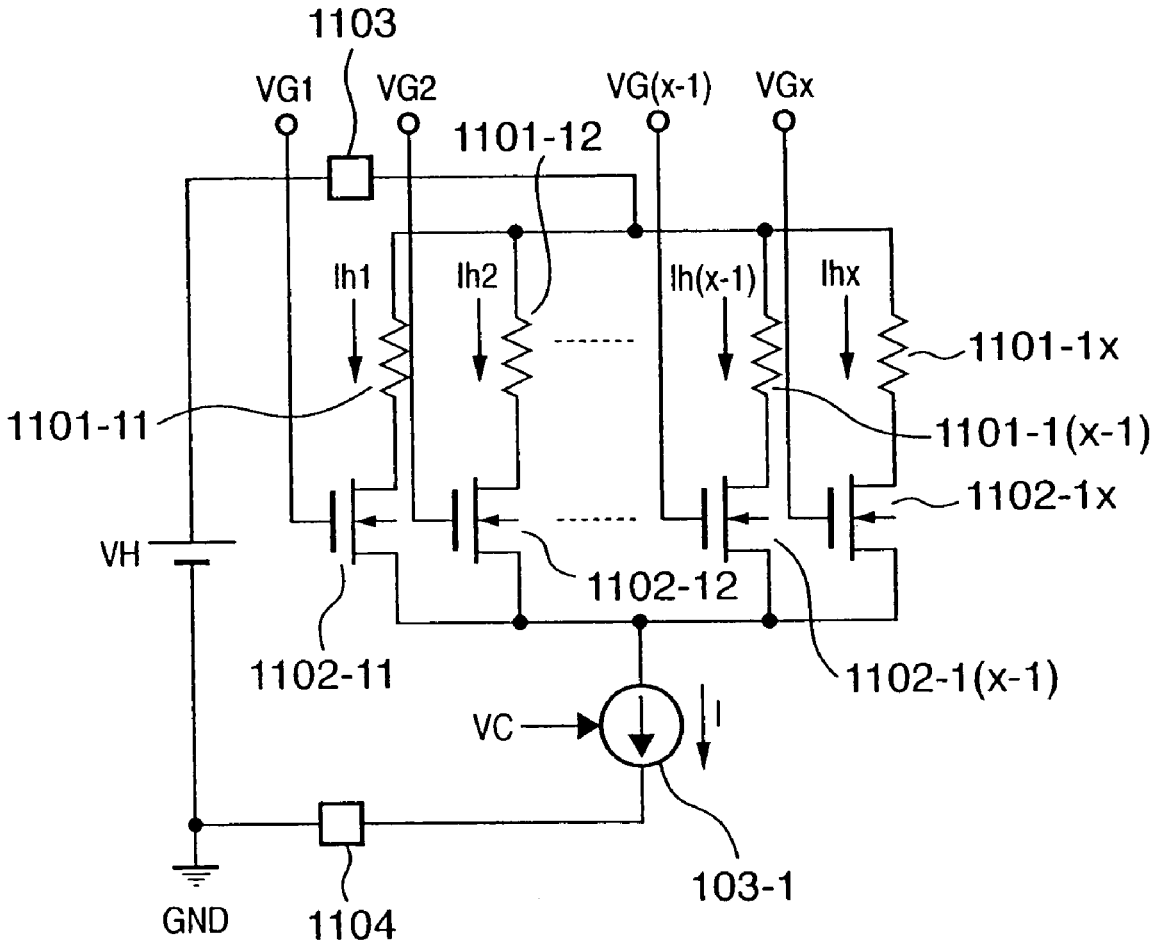
FIG. 6 is a circuit diagram showing the arrangement of one group of the heater driving circuit shown in FIG. 5.

FIG. 6 is a circuit diagram showing the arrangement of one group extracted from the heater driving circuit shown in FIG. 5.

In FIG. 6, the same reference numerals as those in FIG. 14 of the conventional case and FIG. 5 denote the same building components, and a description thereof will be omitted.

In FIG. 6, VG1, VG2, . . . , VG(x-1), and VGx represent control signals which are output from a control circuit 1105 and applied to the gates of the MOS transistors for switching 1102-11, 1102-12, . . . , 1102-1(x-1), and **1102-1*x*. Ih1, Ih2, . . . , Ih(x-1), and Ihx represent electric currents flowing through the heaters 1101-11, 1101-12, . . . , 1101-1(x-1), and 1101-1*x*. VC represents a control signal from the reference current circuit 105**.

For descriptive convenience, the MOS transistors for switching 1102-11 to **1102-1*x* are assumed to ideally operate as 2-terminal switches each having the drain and source. The switch is turned on (drain and source are short-circuited) for the VGi (i=1,x) signal level="H", and off (drain and source are open-circuited) for "L". The constant electric current source 103-1 is assumed to output a constant electric current set by the control signal VC between the terminals (in FIG. 6** from top to down) when a given voltage is applied between them.

Figure 7:
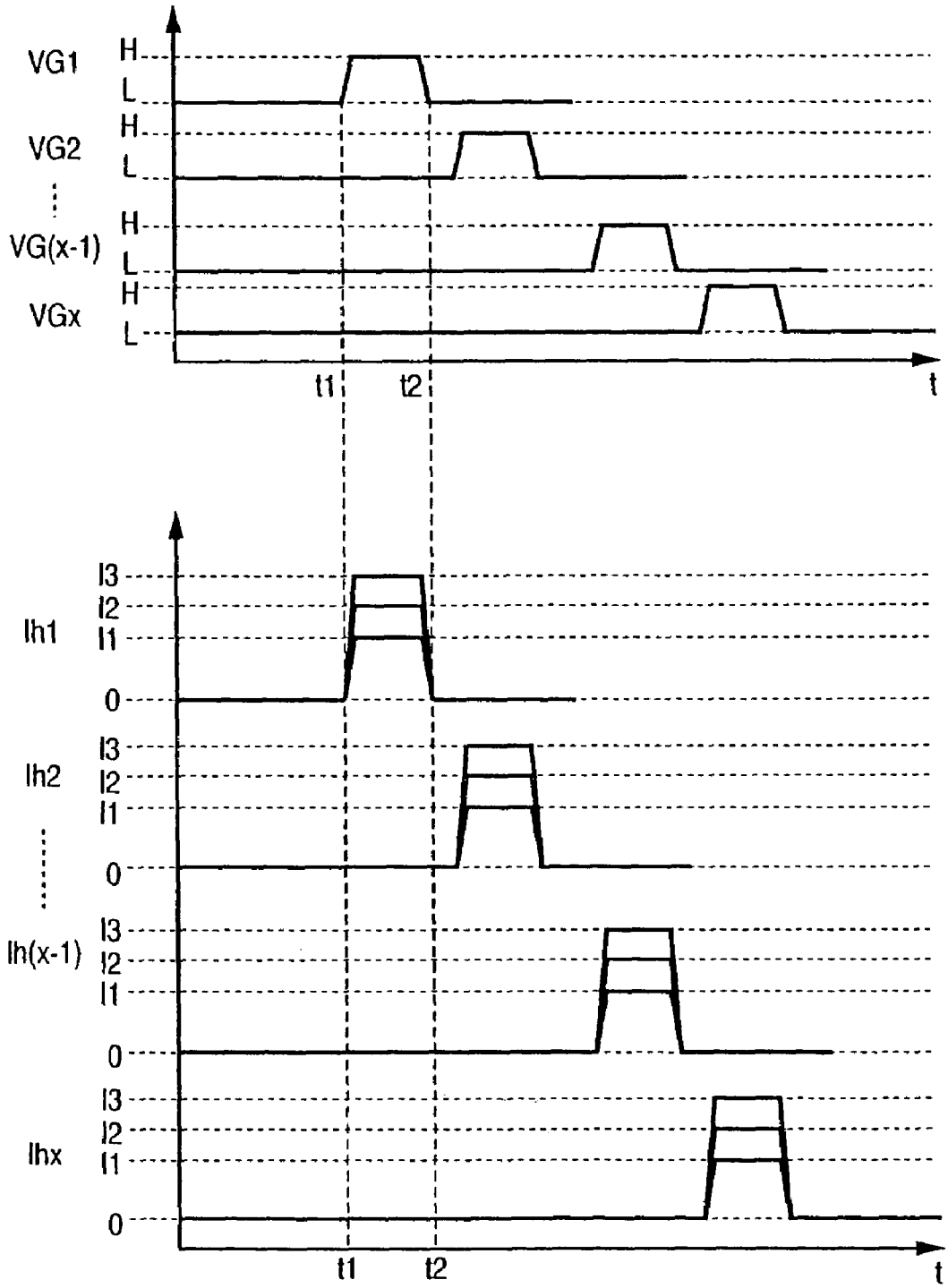
FIG. 7 is a timing chart showing the waveforms of a control signal (VGi) and an electric current (Ihi) flowing through a heater in accordance with the control signal.

FIG. 7 is a timing chart showing the waveforms of the control signal (VGi) and the electric current (Ihi) flowing through a heater in accordance with the control signal.

For example, the control signal VG1 is at "L" during the period up to time t1, the output of the constant electric current source 103-1 and the heater 1101-11 are disconnected, and no electric current flows through the heater. During the period from time t1 to time t2, the control signal VG1 changes to "H", the source and drain of the MOS transistor 1102-11 serving as a constant electric current source are short-circuited, and an electric current output from the constant electric current source 103-1 flows through the heater. After time t2, the control signal VG1 changes to "L" again, and no electric current flows through the heater.

This also applies to the control signals VG2, . . . , and VGx.

The supply time of an electric current to a heater is controlled by the control signal VGi, and the magnitude of the electric current Ihi supplied to the heater is controlled by the control signal VC to the constant electric current source 103-1.

When the electric current flows through the heater 1101-11 during the period from time t1 to time t2, ink on the upper surface of the heater is heated, bubbles, and as a result, is discharged from a corresponding nozzle to print an ink dot.

Similarly, the electric current sequentially flows through the heaters 1101-11 to **1101-1*x* in accordance with signals represented by the timing chart of FIG. 7. Ink dots are printed by discharging heated ink, and then supply of an electric current to the heaters 1101-11 to 1101-1*x*** stops.

With the above arrangement, the reference current circuit 105 sets the output current value of the constant electric current source 103-1, and the set output current flows from the MOS transistors 1102-11 to 1102-1$x$ to the heaters 1101-11 to 1101-1$x$ for a desired time.

In actual operation, there are resistances between the sources and drains when the MOS transistors 1102-11 to 1102-1$x$ are ON. By setting a power supply voltage high enough against a voltage drop caused by the resistances, an electric current output from the constant electric current source substantially flows through the heater, and substantially the same operation as that in the absence of any ON resistance can be implemented.

The circuit layout of the head substrate having the heater driving circuit, which adopts the above circuit arrangement and performs the above operation, according to the present invention will be described below.

First Embodiment

Figure 8:
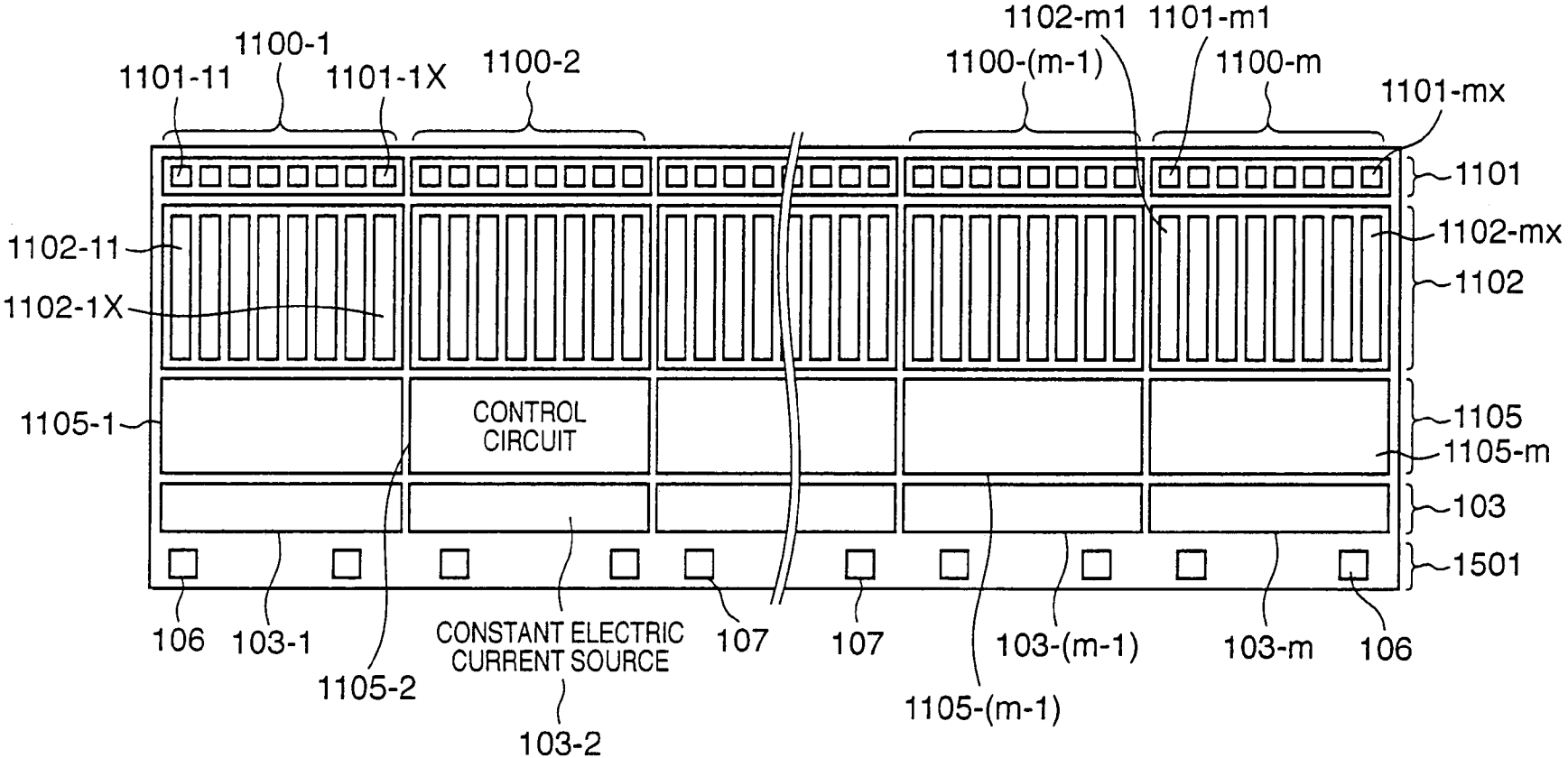
FIG. 8 is a view showing the layout of a head substrate according to a first embodiment of the present invention.

FIG. 8 is a view showing the layout of a head substrate according to the first embodiment of the present invention.

FIG. 8 is an example of a layout for illustrating an actual arrangement of elements, such as the heaters, transistors, control circuits, and constant electric current sources, in the heater driving circuit (equivalent circuit) shown in FIG. 5. Also in FIG. 8, the same reference numerals as those in FIG. 5 denote areas where the corresponding building components are arranged. Note that the head substrate according to the present invention is a rectangular substrate with longer sides and shorter sides. Heaters and transistors for switching are arrayed along with the longer side direction (longitudinal direction).

For example, in a group 1100-1, a heater group and transistor group respectively including heaters 1101-11 to 1101-1$x$ and MOS transistors 1102-11 to 1102-1$x$ are formed. Likewise, in a group 1100-$m$, a heater group and transistor group respectively including heaters 1101-$m$1 to 1101-$mx$ and MOS transistors 1102-$m$1 to 1102-$mx$ are formed. In correspondence with m groups, a constant electric current source group 103 composed of m constant electric current sources 103-1 to 103-$m$ which supply predetermined electric currents to the respective groups is arranged.

A control circuit 1105 is so formed as to be divided into m groups 1105-1 to 1105-$m$ in correspondence with heaters and MOS transistors which belong to the respective groups.

The arrangement intervals between the arrays of the constant electric current sources 103-1 to 103-$m$ which supply the predetermined electric currents to the heaters of the respective groups are set equal to those between the arrays of the m groups 1100-1 to 1100-$m$ each composed from x heaters and x MOS transistors. Each electric supply source is arranged in correspondence to each group.

An input/output pad group 1501, including pads 106 and 107, which provides various contacts (e.g., VH contacts) and electrical contacts with the carriage is arranged along with the longer side direction of the head substrate according to the present invention.

Figure 9:
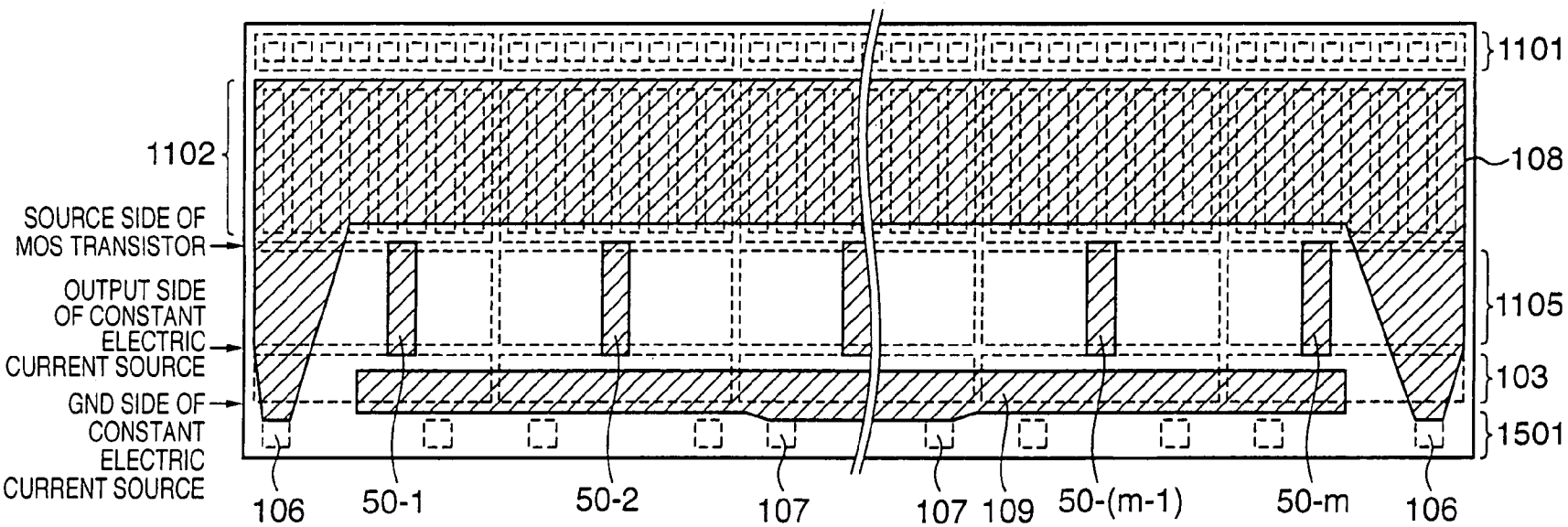
FIG. 9 is a view showing the layout of power supply lines on the head substrate shown in FIG. 8.

FIG. 9 is a view showing the layout of power supply lines portion on the head substrate shown in FIG. 8.

Note that FIG. 3 is part of a cross section of an inkjet printhead using the head substrate shown in FIGS. 8 and 9.

All the elements shown in FIG. 8 are represented by broken lines in FIG. 9, and positioned below power supply lines shown in FIG. 9 because the board has a multi-layered structure.

As shown in FIG. 9, a power supply line 108 is connected to the pads 106 on the power supply side, and connected via VH contacts to the heater group 1101 of the groups 1100-1 to 1100-$m$. Each of wiring lines 50-1 to 50-$m$ is connected to the output terminal of the constant electric current source group 103 and the source terminal of the MOS transistor group 1102. The ground (GND) terminals of the constant electric current source group 103 are connected via a wiring line 109 elongated in the longitudinal direction of the head substrate to the GND pads 107.

As is apparent from FIGS. 8 and 9, in the head substrate according to this embodiment, the array of the heater group 1101 and the array of the input/output pad group 1501 are arranged in substantially parallel to each other along the longer sides of the head substrate. Also, the constant electric current source group 103 is interposed between the control circuit 1105 and the input/output pad group 1501. The heater group 1101, the MOS transistor group 1102, and the control circuit 1105 are sequentially arranged from the end portion of the head substrate.

To heat and bubble ink by a heater and discharge ink from a nozzle, a current of about several tens to several hundreds mA must be supplied to each heater. For efficient power consumption, the power loss and heat generation of an electric current not by a heater but by a wiring line series-connected to the heater must be minimized.

According to this embodiment, the constant electric current source is interposed between the switching element (MOS transistor) and the pad in the configuration of the heater substrate having the layout in which the heater and pad are arranged parallel to each other. Therefore, the intervals between heaters, switching elements, constant electric current sources, and pads, and the lengths of wiring lines connected to pads can be minimized, and thus the power loss by the wiring line can be minimized.

Furthermore, since a constant electric current source in each group is arranged close to an area where heaters, MOS transistors for switching, and the control circuits MOS belonging to the same group are arranged, the lengths of the wiring lines among these elements is substantially the same over the groups. Therefore, the characteristic variations of the circuit over the groups can be suppressed.

As understood from FIGS. 5, 8 and 9, the constant electric current sources are provided for sending an electric current to MOS transistors, and arranged in an area closer to pads than the control circuits. This results in shortening the wiring lengths from pads shared by plural groups to constant electric current sources, and contributes to reducing the operation variation upon driving these circuits.

Second Embodiment

Figure 10:
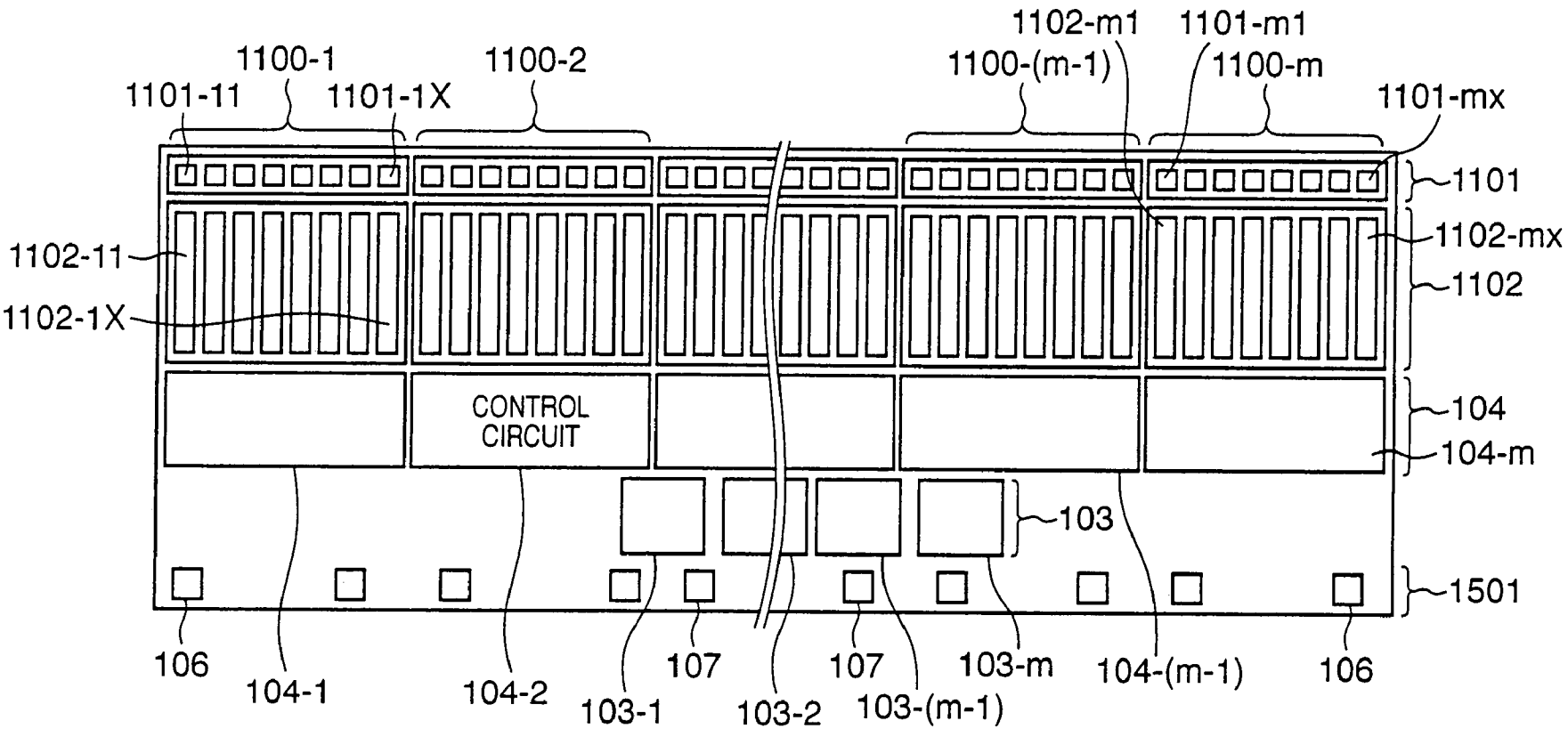
FIG. 10 is a view showing the layout of a head substrate according to a second embodiment of the present invention.

FIG. 10 is a view showing the layout of a head substrate according to the second embodiment of the present invention.

Figure 11:
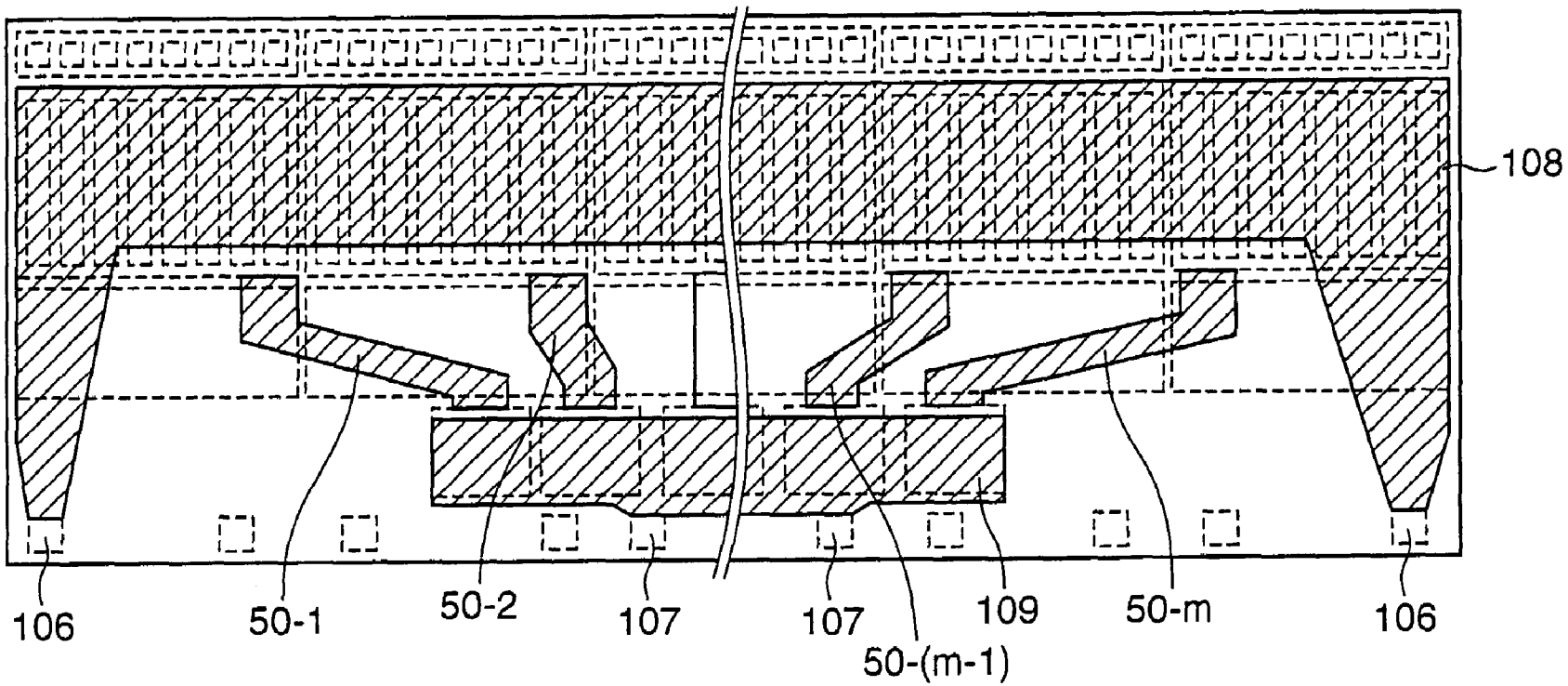
FIG. 11 is a view showing the layout of power supply lines on the head substrate shown in FIG. 10.

FIG. 10 illustrates an example of a layout which implements the heater driving circuit shown in FIG. 5. FIG. 11 is a view showing the layout of power supply lines on the head substrate shown in FIG. 5.

Note that, in FIGS. 10-11, the same reference numerals as those in FIGS. 5, 8 and 9 denote the same building components.

As is apparent from a comparison between FIGS. 8 and 9 described in the first embodiment and FIGS. 10 and 11 in this embodiment, the arrangement of a constant electric current source group 103 is centralized at the center of the board, and the arrangement interval is set smaller than that of the array of a heater group 1101.

According to this embodiment, the distance between constant electric current sources is shortened, and the relative electric current error of an electric current output from each constant electric current source by variations in semiconductor manufacturing process can be reduced. The wiring length from the GND pad 107 to the source of the MOS transistor which constitutes the constant electric current source is shortened, the absolute value of variations in wiring resistance decreases, and the relative error of an output electric current can be similarly reduced.

Third Embodiment

Figure 12:
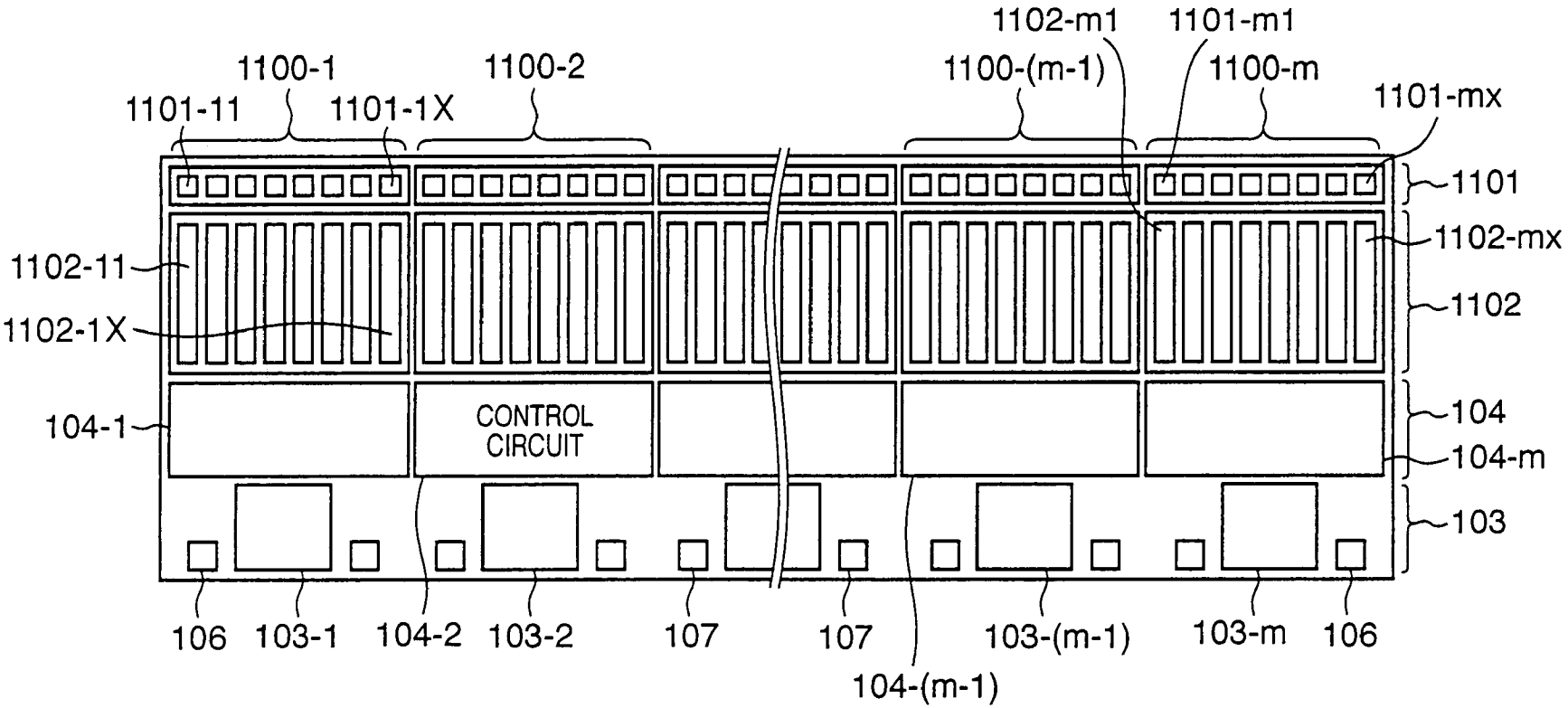
FIG. 12 is a view showing the layout of a head substrate according to a third embodiment of the present invention.

FIG. 12 is a view showing the layout of a head substrate according to the third embodiment of the present invention.

Figure 13:
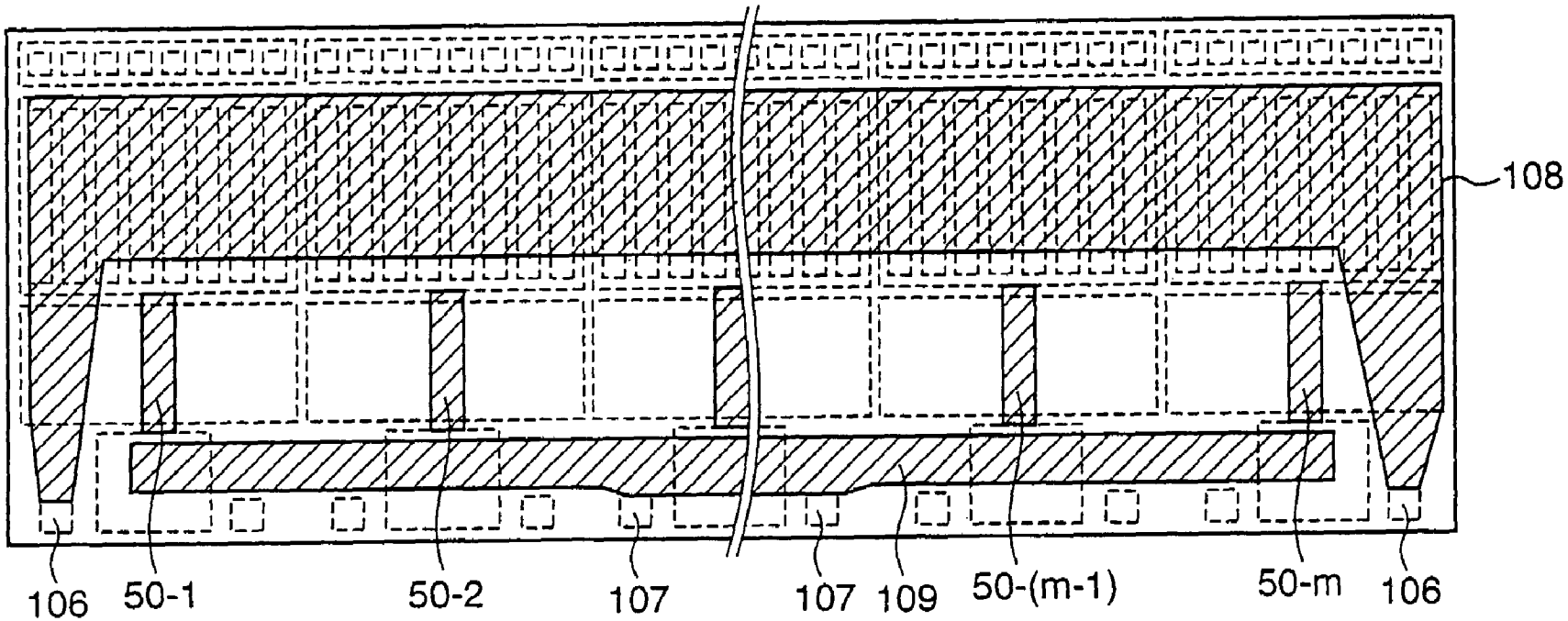
FIG. 13 is a view showing the layout of power supply lines on the head substrate shown in FIG. 10.

FIG. 13 illustrates an example of a layout which implements the heater driving circuit shown in FIG. 5. FIG. 13 is a view showing the layout of power supply lines on the head substrate shown in FIG. 12.

Also in FIGS. 12 and 13, the same reference numerals as those in FIGS. 5, 8, and 9 denote the same building components.

As is apparent from a comparison between FIGS. 8 and 9 described in the first embodiment and FIGS. 12 and 13 in this embodiment, constant electric current sources 103-1 to **103-*m* which constitute a constant electric current source group 103 are interposed between input/output pads 106 and 107**.

The inkjet printhead considered in the present invention achieves high-speed printing by arranging heaters as many as possible and increasing the number of concurrently driven heaters. For this purpose, the heater substrate is elongated in the heater array direction. On a head substrate in which input/output pads are arranged in the heater array direction, the interval between input/output pad arrays is much larger than the pad size, and a satisfactory space can be ensured between pads.

In the third embodiment, the constant electric current source is arranged in this space to suppress an increase in board size by effectively utilizing the space above the board. The third embodiment can reduce a length in a direction (widthwise direction of the head substrate) perpendicular to the heater array, and contributes to cost reduction of the head substrate.

As many apparently widely different embodiments of the present invention can be made without departing from the spirit and scope thereof, it is to be understood that the invention is not limited to the specific embodiments thereof except as defined in the appended claims.

CLAIM OF PRIORITY

This application claims priority from Japanese Patent Application No. 2004-158028 filed on May 27, 2004, the entire contents of which are incorporated herein by reference.

What is claimed is:

1. An inkjet printhead substrate, comprising a plurality of heaters arranged along a longer side direction of a rectangular board near one longer side, a plurality of switching elements respectively corresponding to the plurality of heaters, and a control circuit for controlling drive of the plurality of switching elements, wherein an electric current flows into the plurality of heaters by switching the plurality of switching elements in accordance with a control signal from the control circuit, said substrate further comprising:

a constant electric current source, comprised of a MOS transistor, for supplying a constant electric current to the plurality of heaters; and a plurality of terminals which receive a control signal used to drive the plurality of heaters and are arrayed near another longer side opposite to arrangement positions of the plurality of heaters, wherein the plurality of switching elements, the control circuit, and the constant electric current source are arranged in order in a direction from the arrangement positions of the plurality of heaters to arrangement positions of the plurality of terminals.

2. The inkjet printhead substrate according to claim 1, wherein the constant electric current source comprises a plurality of constant electric current sources, and the plurality of constant electric current sources are arranged at equal intervals in the longer side direction of the board.

3. The inkjet printhead substrate according to claim 1, wherein the constant electric current source comprises a plurality of constant electric current sources, and the plurality of constant electric current sources are arranged in the longer side direction of the board and are further centralized at a center of the board.

4. An inkjet printhead using an inkjet printhead substrate according to claim 1.

5. A head cartridge integrating an inkjet printhead according to claim 4 and an ink tank containing ink to be supplied to the inkjet printhead.

6. The inkjet printhead substrate according to claim 1, wherein the plurality of heaters are grouped into a plurality of groups, and a constant electric current source is provided for each group.

* * * * *

UNITED STATES PATENT AND TRADEMARK OFFICE

CERTIFICATE OF CORRECTION

PATENT NO. : 7,354,139 B2
APPLICATION NO. : 11/137558
DATED : April 8, 2008
INVENTOR(S) : Nobuyuki Hirayama It is certified that error appears in the above-identified patent and that said Letters Patent is hereby corrected as shown below:

COLUMN 1:
Line 19, “discharges” should read -- discharge --.
Line 45, “complete-” should read -- complete --.

COLUMN 3:
Line 4, “lead” should read -- lead to --.
Line 16, “heater” should read -- heaters --.

COLUMN 4:
Line 6, “solved” should read -- solves --.
Line 17, “a terminal” should read -- a plurality of terminals --.
Line 18, “receives which” should be deleted.

COLUMN 5:
Line 9, “into” should read -- onto --.

COLUMN 6:
Line 33, ““inozzle”” should read -- “nozzle” --.

COLUMN 8:
Line 13, “pass” should read -- passes --.

COLUMN 11:
Line 57, “portion” should be deleted.

UNITED STATES PATENT AND TRADEMARK OFFICE

CERTIFICATE OF CORRECTION

PATENT NO. : 7,354,139 B2
APPLICATION NO. : 11/137558
DATED : April 8, 2008
INVENTOR(S) : Nobuyuki Hirayama It is certified that error appears in the above-identified patent and that said Letters Patent is hereby corrected as shown below:

COLUMN 12:

Line 11, "in" should be deleted.

Signed and Sealed this

Twenty-fourth Day of March, 2009

JOHN DOLL
*Acting Director of the United States Patent and Trademark Office*